United States Patent [19]

Svendsen et al.

[11] Patent Number: 5,050,804

[45] Date of Patent: Sep. 24, 1991

[54] SHAFT SEAL FOR PORTABLE PAINT GUN

[75] Inventors: John M. Svendsen, Corcoran; Timothy D. Steinberg, Coon Rapids; Richard W. Gunderson, Elk River, all of Minn.

[73] Assignee: Wagner Spray Tech Corporation, Minneapolis, Minn.

[21] Appl. No.: 560,744

[22] Filed: Aug. 3, 1990

[51] Int. Cl.[5] ..... B05B 7/06

[52] U.S. Cl. ..... 239/296; 239/528; 239/DIG. 14; 277/181; 277/212 R

[58] Field of Search ..... 239/296, 297, 300, 526, 239/527, 528, 583, DIG. 14; 277/212 R, 212 C, 212 F, 181; 92/168

[56] References Cited

U.S. PATENT DOCUMENTS

| | | | |
|---|---|---|---|
| Re. 28,842 | 6/1976 | Butterfield . | |
| 1,626,096 | 4/1927 | Reichenbach . | |
| 1,682,037 | 8/1928 | Craig . | |
| 1,797,209 | 3/1931 | Bramsen et al. . | |
| 1,950,779 | 3/1934 | Bramsen . | |
| 2,557,593 | 6/1951 | Bjorkman . | |
| 2,670,239 | 2/1954 | Ditch | 299/86 |
| 2,888,207 | 5/1959 | Sykes | 239/301 |
| 2,889,183 | 6/1959 | Peras | 277/212 |
| 2,904,262 | 9/1959 | Peeps | 239/583 |
| 3,796,376 | 3/1974 | Farnsteiner | 239/353 |
| 3,907,205 | 9/1975 | Shreve | 239/307 |
| 4,154,403 | 5/1979 | Forrester | 239/528 |
| 4,214,709 | 7/1980 | Scull et al. | 239/707 |
| 4,560,109 | 12/1985 | Teruyuki et al. | 239/583 |
| 4,650,119 | 3/1987 | Pomponi, Jr. | 239/296 |
| 4,667,880 | 5/1987 | Paulsen et al. . | |
| 4,744,571 | 5/1988 | Geberth, Jr. | 277/208 |
| 4,754,923 | 7/1988 | Matusita et al. | 239/68 |
| 4,759,502 | 7/1988 | Pomponi, Jr. et al. | 239/8 |
| 4,760,962 | 8/1988 | Wheeler | 239/289 |

FOREIGN PATENT DOCUMENTS

| | | | |
|---|---|---|---|
| 637582 | 12/1978 | U.S.S.R. | 277/212 F |
| 1551244 | 8/1979 | United Kingdom . | |

OTHER PUBLICATIONS

"Model JGHV Spray Guns," DeVilbiss Service Bulletin SB-2-320-A, The DeVilbiss Company, Toledo, OH 43692-0913, 1989, Note p. 6.

"Handbook: Installation, Operation and Service with Parts Breakdown; Airmix Manual Spray Gun; Model MR—Part Number 129,604,000," Handbook No. 999.100.001, Kremlin, Incorporated, 211 South Lombard, Addison, IL 60101, 14 Mar. 1986, Note p. 8.

"Operation and Maintenance: Kremlin JX/JXLP Gun," Publication Number 999.100.039, Kremlin, Incorporated, 211 South Lombard, Addison, IL 60101, Note p. 5, (not date).

"Binks MACH 1 HVLP Spray Gun," Part Sheet 2463, Binks Manufacturing Company, 9201 West Belmont Avenue, Franklin Park, IL 60131, 1989 Note p. 4.

"Capspray: Owner's Manual; Model 2020 Spray Gun," Faribo Cap-Tech, Inc., P.O. Box 388, 619 Park Avenue, Faribault, MN 55021, 1983-87, Notes pp. 6 and 7, (no date).

"Accuspray Series #10 Spray Gun," The Accuspray System by Bessam Aire, P. O. Box 46478, Cleveland, OH 44146-0478, (no date).

*Primary Examiner*—Andres Kashnikow
*Assistant Examiner*—Karen B. Merritt
*Attorney, Agent, or Firm*—Faegre & Benson

[57] ABSTRACT

An improved control shaft seal and air valve for a portable paint gun with the seal having a radial clearance with the shaft except at a shaft sealing surface of limited axial length. The shaft seal has a conical surface radially outward of the shaft sealing surface to provide a sealing surface and also to provide transfer of axial forces at that surface to a radial direction to provide a force to urge the shaft sealing surface against the control shaft. A second conical surface of the seal provides for retention of the seal on an air valve spring when the paint gun is disassembled. An improved air valve for portable paint guns is also disclosed having a rigid axial hub and radial support carrying a relatively flexible rim portion adapted to engage a tapered seating surface in the gun.

11 Claims, 4 Drawing Sheets

SHAFT SEAL FOR PORTABLE PAINT GUN

BACKGROUND OF THE INVENTION

This invention pertains to the field of portable painting equipment, more particularly to portable paint guns referred to as high volume low pressure or HVLP type paint guns. In the past, such guns have been characterized by relatively complex and costly sealing mechanisms to prevent the escape of pressurized air from the interior of such guns. The present invention provides an improved apparatus for preventing the escape of pressurized air in a simple and efficient structure.

DETAILED DESCRIPTION

Figure 1:
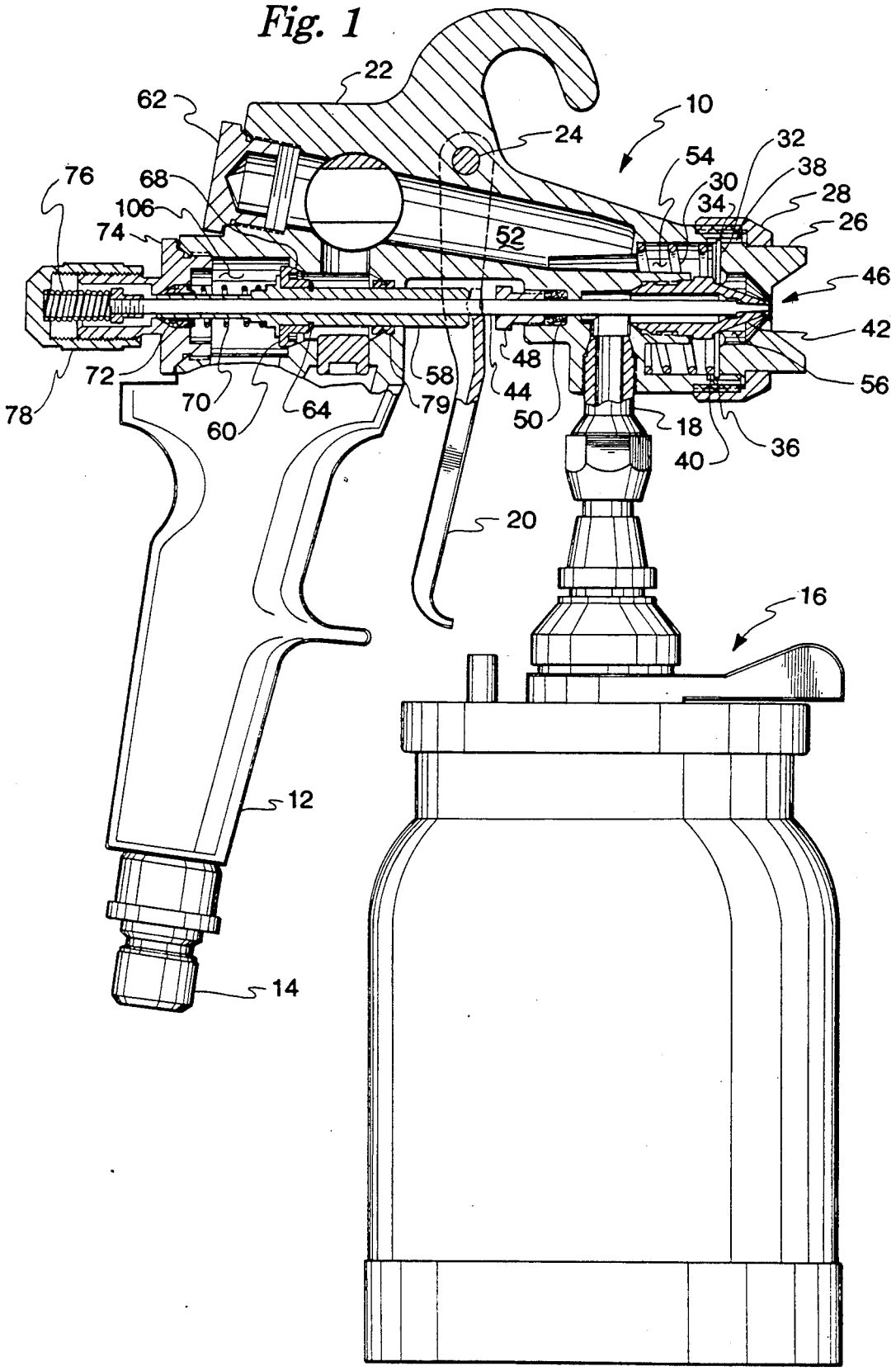
FIG. 1 is a right side elevation view of the present invention with parts cut away and with movable parts shown in an OFF position.

Referring now to the drawings and more particularly to FIG. 1, a portable paint gun 10 may be seen. Gun 10 has a handle 12 which is preferably hollow, and through which compressed air can pass when connected to a source of compressed air via fitting 14. Gun 10 further has a paint cup 16 having a siphon tube 18 to draw paint out of paint cup 16 in operation. Gun 10 further has a trigger 20 pivotably mounted to a gun body 22 via a trigger pin 24.

Gun 10 further has an air cap 26 retained by a locking ring 28 on body 22. An air cap spring 30 is preferably secured to a detent plate 32, as for example, by spot welding. Detent plate 32 preferably has projections 34, 36 which are retained respectively in slots 38, 40 to prevent rotation of plate 32. Plate 32 preferably has a cruciform opening interdigitated with projections on plate 32 (not shown) which are received in mating recesses (not shown) in air cap 26. The detents in plate 30 and recesses in cap 26 cooperate to hold cap 26 in one of three predetermined positions to provide for control of the paint pattern in a manner well known. Gun 10 further has a fluid nozzle 42 which cooperates with a needle 44 to form a needle or paint valve 46 to control the flow of paint or other material delivered by gun 10. A needle packing nut 48 is preferably threaded into body 22 to compress needle packing 50 against needle 44.

Gun 10 also has an air passageway 52 in communication with a plenum 54 surrounding fluid nozzle 42. Plenum 54 is in communication with recess 56 in air cap 26. Trigger 20 is in contact with an air valve shaft 58 surrounding needle 44 and carrying an air valve 60. An air plug 62 is preferably threaded into body 22 to close off an alternative inlet to passageway 52. In the configuration shown in FIG. 1, gun 10 is arranged for "non-bleeder" operation. By interchanging plug 62 with fitting 14, and supplying air directly to passageway 52, gun 10 would be configured for "bleeder" operation.

Valve 60 is retained on shaft 58 by a retaining ring 64 on one side of valve 60 and by a flange 66 on the other side of valve 60. Valve 60 is urged toward a mating seat 68 by an air valve spring 70. Air valve spring 70 is also in contact with a shaft seal 72. Shaft seal 72 seals shaft 58 against a material adjustment housing 74 threaded into gun body 22. A needle spring 76 is retained by a material adjustment knob 78 threaded on housing 74 and spring 76 urges needle 44 forward against nozzle 42 to maintain needle valve 46 in a closed position.

A bushing 79 preferably formed of plastic serves as a guide and air seal around shaft 58 and holds shaft 58 and needle 44 in alignment during assembly and operation of gun 10. It is to be understood that bushing 79 need not be an "air-tight" seal since it only needs to prevent air leakage along shaft 58 when valve 60 is in the intermediate and ON positions.

Figure 2:
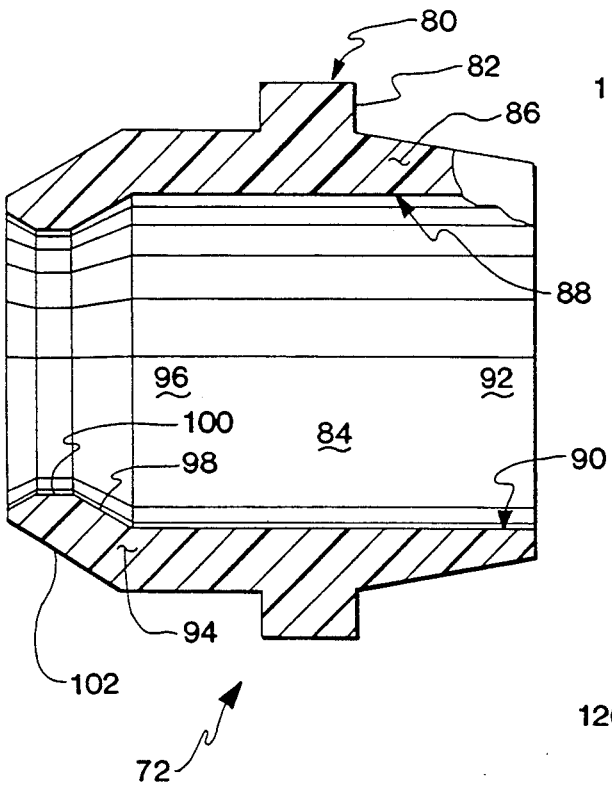
FIG. 2 is an enlarged side elevation detail of the shaft seal of the present invention.

Referring now more particularly to FIG. 2, various details of the shaft seal 72 may be seen. Seal 72 has a mediate portion 80 having a radially outwardly projecting flange 82 and a generally cylindrical interior recess 84 located radially inwardly of the flange 82. Seal 72 further has a first conical rim 86 extending axially in a first direction away from flange 82 with a shallow conical taper from a relatively thicker cross-section 88 proximal of the flange 82 to a relatively thinner cross-section 90 distal of flange 82. Shaft seal 72 further has a first extension 92 of the generally cylindrical interior recess 84 with extension 92 located radially inwardly of surface 86.

Seal 72 further has a second conical rim 94 extending axially in a second direction opposite the first direction away from flange 82 and further has a second extension 96 of the generally cylindrical interior recess 84 extending axially along and radially inward of rim 94.

Rim 94 of seal 72 has a conical inner surface 98 extending from the second extension 96 of the generally cylindrical interior recess 84 to a cylindrical shaft sealing surface 100 which is located axially distal of the flange 82 in the second direction. Rim 94 also has a tapered sealing surface 102 having an external conical taper adapted for contacting and interfitting with a mating correspondingly tapered bore or chamfer 104 in element 74 of paint gun 10 such that shaft seal 72 prevents the passage of air between the control shaft 58 and the shaft sealing surface 100 and also from between the sealing surface 102 and the tapered bore 104 when pressurized air is present in chamber 106.

It is to be understood that first conical rim 86 is sized to mate in an interference fit with cylindrical compression spring 70 to retain seal 72 on spring 70 when gun 10 is disassembled. It is further to be understood that spring 70 acts against flange 82 to urge seal 72 in the second direction with respect to the control shaft 58. In a preferred embodiment, the first conical rim 86 tapers from 0.228 inches diameter to 0.311 inches diameter and the spring 70 has an internal diameter of 0.316 inches.

It is further to be noted that the tapered sealing surface 102 of conical rim 94 preferably has a taper substantially equal to a taper of the conical inner surface 98 providing a constant cross-sectional thickness of rim 94 between surfaces 98 and 102. It is further to be understood that the cylindrical interior recess 84, along with its extensions 92, 96 preferably has a diameter substantially greater than the diameter of the control shaft around which the seal 72 is located such that there is a radial clearance between shaft 58 and recess 84, together with its extensions 92, 96. Furthermore, the shaft sealing surface 100 preferably has an axial length that is relatively short with respect to the axial length of the overall shaft seal 72 (e.g. less than ten percent) such that the resistance to relative axial movement between the control shaft 58 and the seal 72 is minimized.

In a preferred embodiment, surface 100 is 0.025 inches long while seal is 0.365 inches long overall. Surfaces 98, 102 and 104 each preferably have a conical taper of 30 degrees.

In operation, pressure from spring 70 forces seal 72 against the tapered bore or chamfer 104 in the material adjustment housing 74 creating an airtight seal. Axial force or pressure generated by spring 70 is transferred to a radial force by the interaction of surfaces 102, 104 thus urging surface 100 against shaft 58 (making use of the conical flexibility of rim 94), forming an airtight seal. As seal 72 wears at surface 100, seal 72 is permitted to move axially in the second direction as urged by spring 70 to maintain sufficient pressure to insure sealing between shaft 58, seal 72 and housing 74.

Figure 3:
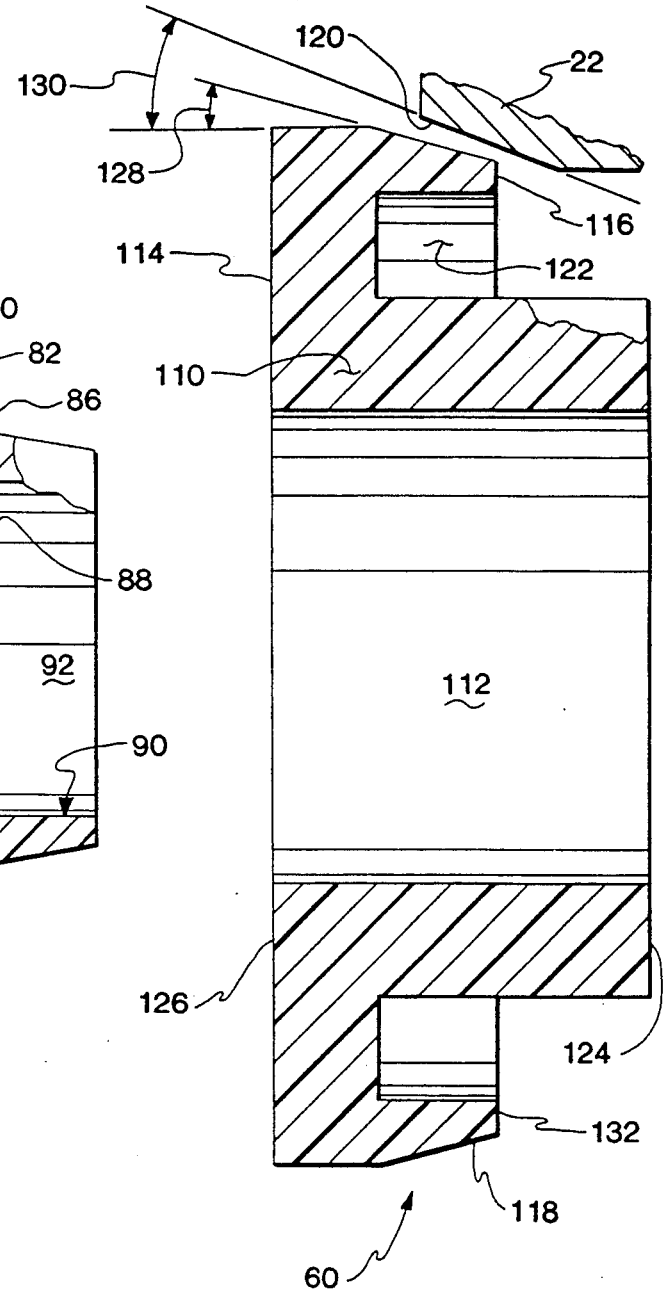
FIG. 3 is an enlarged side elevation detail of an air valve for the gun of the present invention.

Referring now more particularly to FIG. 3, various details of the air valve 60 may be seen. Valve 60 has a generally cylindrical axially extending hub portion 110 having a through bore 112, a radially outwardly projecting support portion 114 mounted on the hub portion 110, and a generally conical outer rim portion 116 extending coaxially with hub portion 110 and mounted on support portion 114 radially outwardly of hub portion 110. Rim portion 116 has a tapered sealing surface 118 adapted for matingly interfitting with a tapered valve seating surface 120 in the body 22 of gun 10. Valve 60 further has an axial recess 122 located in a region radially inward of the tapered sealing surface of rim portion 116. The hub portion 110 of valve 60 has a first shoulder 124 and a second shoulder 126 for locating the valve in first and second axial directions on shaft 58. Shoulder 124 is held by retaining ring 64 and shoulder 126 is held by flange 66 on shaft 58.

Both seal 72 and valve 60 are preferably formed of a relatively resilient material such as virgin polytetrafluorethylene as sold under the trademark TEFLON by EI Dupont de Nemours Co. The material of valve 60 is preferably homogeneous with the rim portion 116 being relatively flexible with respect to the hub and support portions 110, 114 such that sealing surface 118 conforms to the seating surface 120 when valve 60 is drawn against the seating surface 120. Surface 118 preferably has an external conical angle 128 of 16 degrees, while seating surface 120 preferably has an internal conical angle 130 of 18 degrees.

Rim portion 116 provides a "forgiving" alignment between seal 60 and seating surface 120. The flexibility of rim portion 116 allows the tapered sealing surface 118 to conform to radial and axial misalignment between seal 60 and gun body 22. Because angle 130 is greater than angle 128, a leading edge 132 of the sealing surface 118 will contact surface 120 first. It has been found preferable that hub portion 110 and support portion 114 are relatively rigid with respect to rim portion 116 which is relatively conically flexible and provides a secondary seal area along surface 118 distal of leading edge 132, thus compensating for creep or cold flow of lip portion 116 during the operating lifetime of gun 10. The rigidity of support portion 114 also provides a radial clearance protection of rim portion 116 to reduce the possibility of damage during storage and handling of valve 60 prior to assembly into gun 10.

Figure 4:
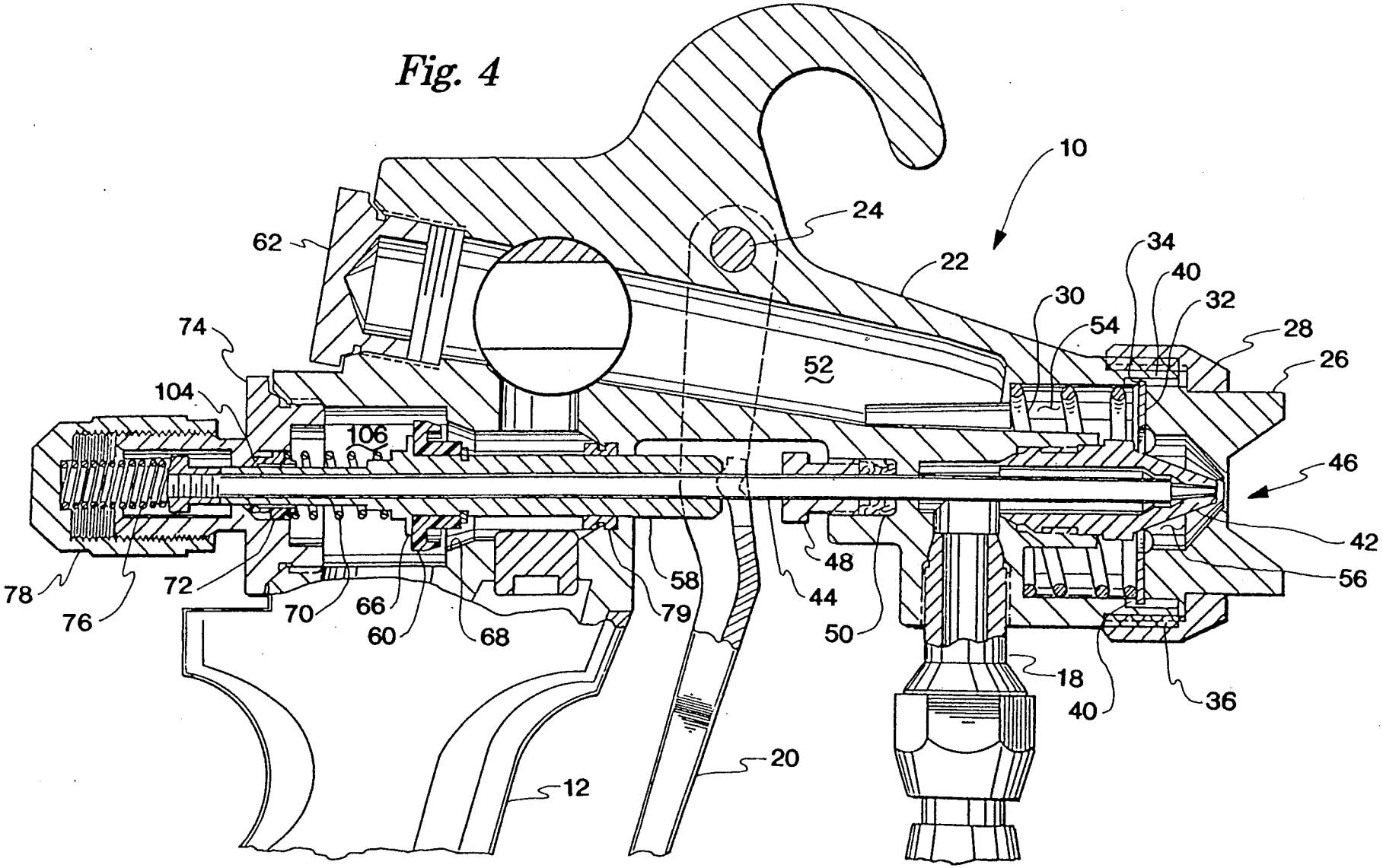
FIG. 4 is a fragmentary right side elevation view as seen in FIG. 1 with movable parts in an intermediate position.
Figure 5:
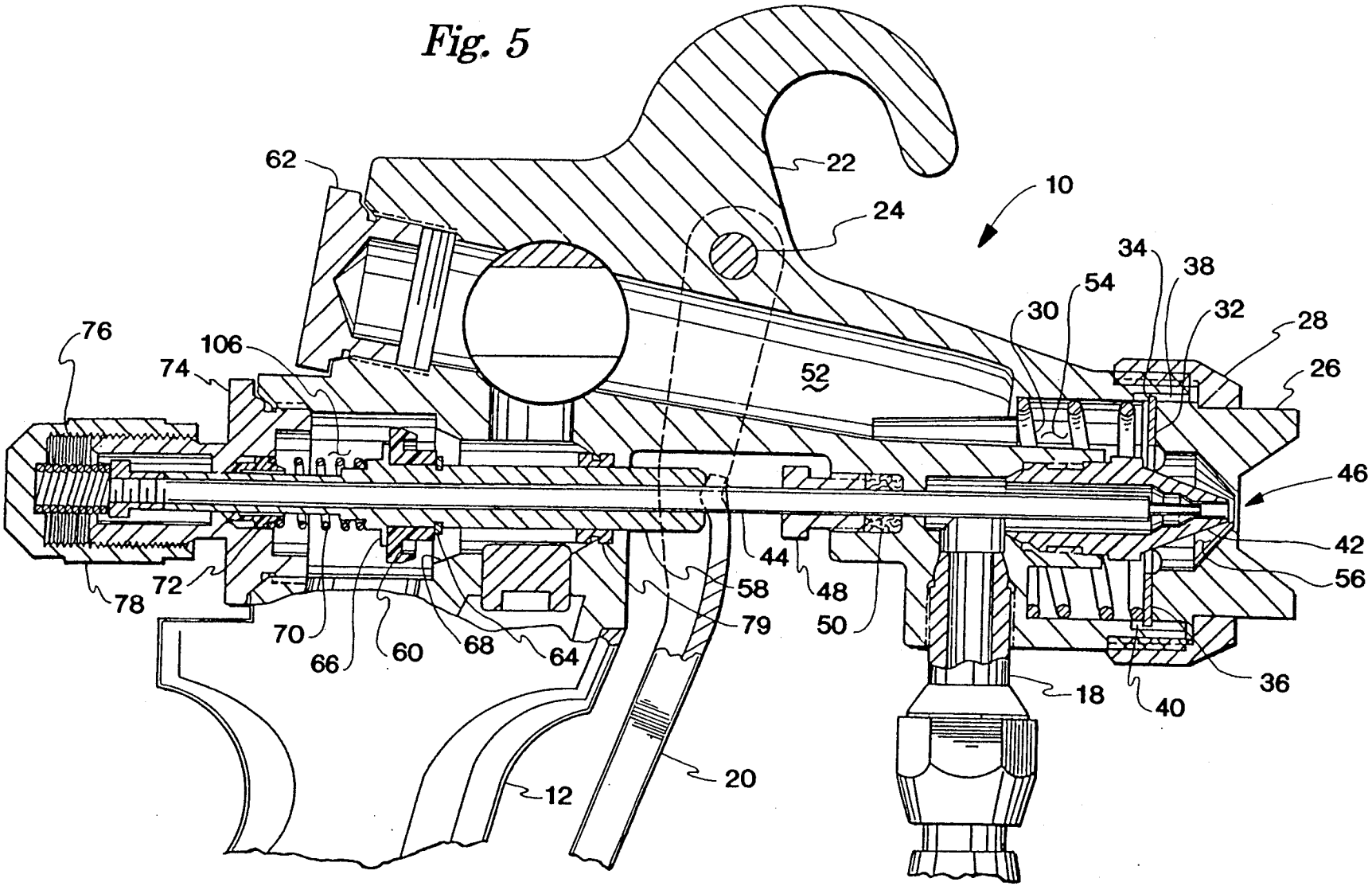
FIG. 5 is a fragmentary right side elevation view with movable parts in an ON position.

Referring now to FIGS. 4 and 5, along with FIG. 1, the operation of the air valve and seal is as follows:

In FIG. 1, the gun is shown in an OFF position with both the paint or needle valve 46 and air valve 60 in a closed position. Paint valve 46 is closed when needle 44 is its forwardmost position and is contacting the interior of fluid nozzle 42. Air valve 60 is in the closed position when control shaft 58 is in the forwardmost or closed position. With the gun configured for "non-bleeder" operation, retracting trigger 20 from the OFF or closed position shown in FIG. 1 to an intermediate position as shown in FIG. 4, will move control shaft 58, but not needle 44, thus opening passageway 52 to the source of pressurized air by moving air valve 60 away from seating surface 120 permitting the passage of air therethrough. Further progression of trigger 20 from the position shown at FIG. 4 to the position shown in FIG. 5 will move the control shaft 58 axially within seal 72 further in the second direction causing the control shaft to drive needle 44 against spring 76 opening the needle valve 46.

Thus, it may be seen that in FIG. 1, both the paint valve 46 and the air valve 60 are in the OFF position. In FIG. 4, the air valve 60 is in the ON position while the paint valve 46 remains in the OFF position. In FIG. 5, both the paint valve 46 and the air valve 60 are in the ON position.

It is to be understood that as trigger 20 is released, the paint valve 46 will move to the OFF position as shown in FIG. 4, while the air valve 60 will remain ON, thus clearing paint from air cap 26 and the exterior of fluid nozzle 42. Further release of trigger 20 will permit movement of control shaft 58 to the closed position for air valve 60 such that the sealing surface 118 conforms to the seating surface 120 when the control shaft is in the closed position of FIG. 1. It can thus be seen that the mating, sealing and seating surfaces 118, 120 are in contact with each other when the control shaft 58 is in a closed position and the sealing and seating surfaces 118, 120 are axially spaced from each other when the control shaft 58 is displaced axially away from the closed position. It is to be understood that seal 72 maintains an air seal between itself and control shaft 58 in each of the positions shown in FIGS. 1, 4 and 5 and while shaft 58 is moving among those positions.

The invention is not to be taken as limited to all of the details thereof as modifications and variations thereof may be made without departing from the spirit or scope of the invention.

What is claimed is:

1. In a portable paint gun of the type having a control shaft for controlling a supply of pressurized air to atomize a selectively provided stream of paint, an improved shaft seal in combination therewith comprising:

a) a mediate portion having a radially outwardly projecting flange and a generally cylindrical interior recess located radially inwardly of the flange;

b) a first conical rim extending axially in a first direction away from the flange and having a shallow taper from a relatively thicker cross section proximal of the flange to a relatively thinner cross section distal of the flange and having a first extension of the generally cylindrical interior recess radially inwardly of the first conical rim;

c) a cylindrical portion extending axially in a second direction opposite the first direction away from the flange and having a second extension of the generally cylindrical interior recess extending axially along and radially inwardly thereof;

d) a second conical rim extending axially in the second direction from the cylindrical portion; and e) a conical inner surface extending from the second extension of the generally cylindrical interior recess to a cylindrical shaft sealing surface located axially distal of the flange in the second direction wherein the second conical rim has a tapered sealing surface adapted for interfitting and in contact with a mating correspondingly tapered bore in an element of the paint gun such that the shaft seal prevents the passage of air between the control shaft and the shaft sealing surface and between the sealing surface and the tapered bore.

2. The improved shaft seal and gun of claim 1 wherein the first conical rim is adapted to mate in an interference fit with a generally cylindrical compression spring acting axially against the flange to urge the seal in the second direction with respect to the control shaft.

3. The improved shaft seal and gun of claim 2 wherein the first conical rim has a conical taper of about ten degrees.

4. The improved shaft seal and gun of claim 2 wherein the first conical rim tapers from about 0.228 inches diameter to about 0.311 inches diameter and the spring has an internal diameter of about 0.316 inches.

5. The improved shaft seal and gun of claim 1 wherein the tapered sealing surface of the second conical rim has a taper substantially equal to a taper of the conical inner surface.

6. The improved shaft seal and gun of claim 1 wherein the cylindrical interior recess has a diameter substantially greater than a diameter of the control shaft around which the seal is located such that there is a radial clearance between the shaft and the cylindrical interior recess and further wherein the shaft sealing surface has an axial length that is relatively short with respect to an axial length of the overall shaft seal such that the resistance to relative axial movement between the shaft and the seal is minimized.

7. The improved shaft seal and gun of claim 1 wherein the shaft seal is formed of resilient material.

8. The improved shaft seal and gun of claim 7 wherein the shaft seal is formed of polytetrafluorethylene.

9. The improved shaft seal and gun of claim 1 wherein the tapered sealing surface has a conical taper of about thirty degrees.

10. The improved shaft seal and gun of claim 9 wherein the conical inner surface has an internal conical taper substantially equal to the taper of the conical sealing surface.

11. The improved shaft seal and gun of claim 10 wherein the internal conical taper is about thirty degrees.

* * * * *